US011624567B2

(12) United States Patent
Desset

(10) Patent No.: US 11,624,567 B2
(45) Date of Patent: Apr. 11, 2023

(54) ACTIVE DEVICE FOR TOTAL INHIBITION OF THE RECOIL OF FIREARMS IN THE AXIS OF THE BARREL

(71) Applicant: Samuel Desset, Faro (PT)

(72) Inventor: Samuel Desset, Faro (PT)

( * ) Notice: Subject to any disclaimer, the term of this patent is extended or adjusted under 35 U.S.C. 154(b) by 35 days.

(21) Appl. No.: 17/435,968

(22) PCT Filed: Mar. 2, 2020

(86) PCT No.: PCT/HR2020/050413
§ 371 (c)(1),
(2) Date: Sep. 2, 2021

(87) PCT Pub. No.: WO2020/178515
PCT Pub. Date: Sep. 10, 2020

(65) Prior Publication Data

US 2022/0146218 A1 May 12, 2022

(30) Foreign Application Priority Data

Mar. 4, 2019 (FR) ..... 1902159

(51) Int. Cl.
*F41A 1/08* (2006.01)

(52) U.S. Cl.
CPC ..... *F41A 1/08* (2013.01)

(58) Field of Classification Search
CPC ..... F41A 1/08; F41A 25/02; F41A 25/26
See application file for complete search history.

(56) References Cited

U.S. PATENT DOCUMENTS 462,970 A * 11/1891 Barnes ..... F41A 25/02 188/289
1,877,118 A * 9/1932 Barnes ..... F41A 25/02 126/41 R
2,489,748 A * 11/1949 Dennistoun ..... F41A 1/08 89/1.703
2,638,339 A * 5/1953 Taylor ..... F41A 25/02 89/44.01
2,965,000 A * 12/1960 Skinner ..... F41A 1/04 89/7

(Continued)

FOREIGN PATENT DOCUMENTS

DE 2040863 A1 3/1972
DE 102007005939 A1 8/2008
EP 3015811 A1 5/2016

*Primary Examiner* — Derrick R Morgan
(74) *Attorney, Agent, or Firm* — H&I Partners; C. Andrew Im; Jean-Christophe Hamann

(57) ABSTRACT

The device aligned with the axis of the barrel of a firearm is configured to equalize, as well as possible, the momentum generated by the projectile and the burnt gases, by projecting a mass of fluid at a given speed in the opposite direction. The device includes a support to be attached to the weapon, a primary valve mechanism, a secondary valve mechanism and a duct for the gases to flow along. The secondary valve mechanism to seal and fill the tank with a pressurized fluid provided by an external system. The primary valve mechanism to seal and expel the fluid in a discharge zone. The device is particularly intended for military applications in order to improve the grouping of shots and to reduce the costs and limitations of using the barrels.

11 Claims, 6 Drawing Sheets

CROSS-SECTION B-B

(56) References Cited

U.S. PATENT DOCUMENTS

| | | | | | |
|---|---|---|---|---|---|
| 4,043,248 | A * | 8/1977 | Bulman | F41A 1/04 | 89/1.703 |
| 4,050,348 | A * | 9/1977 | Graham | F41A 1/04 | 89/7 |
| 4,307,652 | A * | 12/1981 | Witt | F41A 21/36 | 89/14.3 |
| 4,934,242 | A * | 6/1990 | Bulman | F41A 1/04 | 102/440 |
| 4,962,689 | A * | 10/1990 | Phan | F41A 1/08 | 89/1.703 |
| 7,418,896 | B1 * | 9/2008 | Dindl | F41A 19/13 | 89/1.701 |
| 2008/0289236 | A1 * | 11/2008 | Fischer | F41A 21/36 | 42/1.06 |
| 2010/0282057 | A1 * | 11/2010 | Rapp | F41A 1/08 | 235/404 |
| 2022/0260329 | A1 * | 8/2022 | Huang | F41A 1/10 | |

* cited by examiner

CROSS-SECTION B-B

ACTIVE DEVICE FOR TOTAL INHIBITION OF THE RECOIL OF FIREARMS IN THE AXIS OF THE BARREL

RELATED APPLICATIONS

This application is a § 371 application of PCT/FR2020/050413 filed Mar. 2, 2020, which claims priority from French Patent Application No. 19 02159 filed Mar. 4, 20219, each of which is incorporated herein by reference in its entirety.

TECHNICAL FIELD

The invention belongs to the field of devices for assistance in firing a firearm.

More particularly, the invention belongs to the field of devices for assistance in firing a firearm, by absorbing the recoil of the weapon.

More particularly, the invention belongs to the field of devices for assistance in firing a firearm, by actively absorbing the recoil of the weapon.

BACKGROUND OF THE INVENTION

Shooting a projectile with a firearm generates a momentum that is generally applied on the breech in the direction opposite the movement of the projectile.

This momentum is transmitted to the rest of the weapon, then to the individual or the support bearing the weapon. According to the rigidity of the system, the recoil force can be more or less substantial according to the time spread during which the support will dissipate the energy associated with the recoil.

This recoil force generates violent pulses, that require systems to limit the forces on the support. Each shot disturbs the precision of the following shots. For larger barrels, it is necessary to use dampers and/or complex mechanisms of which some bear against the ground in order to be able to contain this impulsion.

In the current and future conflicts, using a firearm via aerial drones is and will be highly limited by the momentum generated by the weapon during the firing. Although a current drone can transport a large-caliber weapon, it cannot use it repeatedly, because from the first shot, the stability of the drone is compromised rendering the following shots non-grouped, even random and dangerous.

Different systems for absorbing the recoil of a firearm exist (the flow of gases, springs, muzzle brake). However most decrease the pulse due to a peak in the force by dissipating the energy over a longer period of time. Others divert a portion of the burned gases perpendicularly to the projectile.

Barrels without recoil are for example known today, these barrels include tubes that guide a projectile that is self-propelled. Starting with use for standard ammunition they progressively were found useful against anti-tank weapons. The former were used during World War I (e.g., Davis gun). The combustion gases are used to push the shells in the barrel by bearing against the air at the rear of the barrel.

The loss of energy towards the rear is considerable and limits the use of this system because the speed of the shell is slow and the ammunition must be customized. Guide tubes have progressively become interesting with the appearance of self-propelled ammunition, and particularly that with shaped charges thanks to their effectiveness independent of the speed of the ammunition. Today, these guide tubes can be found under names such as rocket launchers, RPG, bazooka etc.

Another example operating on the same principle that the guide tubes are gas launchers that use a fluid to push the ammunition in one direction and bear against the air such as the device described in U.S. Pat. No. 2,965,000A.

The particularity of these weapons is that they are specifically designed to not have any recoil and not a solution that can be adapted to the multitude of barrels. In addition, these existing systems are limited in effectiveness except those that use self-propelled ammunition.

The present invention proposes a radical solution to this problem: The total inhibition in the axis of the barrel of the recoil transmitted to the support by means of a device attached to the rear of a weapon.

OBJECT AND SUMMARY OF THE INVENTION

The invention relates to a device for inhibition of the recoil of firearms, and in order to be effective, the device must be perfectly aligned with the axis of the projectile/breech.

More particularly, the invention relates to a device for inhibition in the axis of the barrel of the recoil intended for being implemented with a firearm, said device carrying out a discharge of pressurized fluid in a direction opposite the firing of the barrel to absorb the recoil of the weapon, characterized in that said device is attached to the rear of said weapon and includes:

- a support to be attached to the weapon;
- an exclusive tank of said device and including the fluid to be discharged;
- a secondary mechanism for sealing and filling the tank by an external system intended for supplying said tank and being independent from the firearm;
- a system transmitting an order for discharging fluid synchronized with the firing of the weapon;
- a primary mechanism for sealing and discharging fluid;
- a part with a discharge zone including a neck cooperating with said primary mechanism.

The final purpose being that the fluid expelled at a certain speed through the discharge zone equals in momentum that of the projectile and of the burned gases. The shape of the discharge zone, the pressure and volume of the fluid in the tank can be optimized for each type of firearm ranging from small caliber to the artillery gun.

The device of the invention can also include all or one of the following characteristics in any technically permissible combination:

- The discharge zone includes said neck, an expansion zone, and an outlet section having the shape of a de Laval nozzle.
- The discharge zone has a flow profile with a converging then diverging shape, and wherein the length and the diameter at the end of the divergent make it possible to equalize the pressures between the fluid expelled and the external environment.
- The pressurized fluid can be in its liquid or gaseous state, hot or cold, or result from a combustion.
- The support and the weapon can be attached to one or more parts or intermediate mechanisms.
- The primary mechanism is configured to allow for the discharging of a quantity of pressurized fluid generating a momentum at an outlet section of the discharge part equal to the momentum generated by the firing and the combustion gas of said weapon.

The discharge zone is sized to generate said desired momentum when the fluid passes through its outlet section.

The pressurized fluid is chosen from a pressurized gas or a mixture of pressurized gases, air, CO2, water or any other liquid.

The primary mechanism making it possible to discharge pressurized fluid in the part with the discharge zone uses a mechanism chosen from an electrical, mechanical, electromechanical or hydraulic mechanism to actuate and/or control the discharging of fluid. For example, a cylinder or an electromechanical force transmitting the order to discharge to a valve of the primary mechanism following the detection of a rise in gas combustion pressure of the weapon or the movement of the breech with respect to the frame.

The device is configured to carry out the filling of the tank from an external source of fluid and following each firing of the weapon, or continuously in order to maintain a predefined level of fluid and/or pressure of fluid.

The secondary mechanism for the filling of the tank uses a mechanism chosen from an electrical, mechanical, electromechanical or hydraulic mechanism to actuate the filling of the tank. For example the device uses the movement of the breech in relation to the frame to actuate a valve of said secondary mechanism allowing for the filling of the tank.

The primary mechanism includes means for adjusting the discharge time of pressurized fluid, such as a return spring or a timer.

In a preferred embodiment, the system transmitting the order to discharge (14) of the device of the invention includes:

a duct including an incompressible fluid and able to be connected with a duct for the gases to flow along of the weapon when the device is attached with said weapon, said duct opening onto the primary mechanism for sealing and discharging the tank, and in which device the order to discharge is transmitted by the incompressible fluid transmitting a rise in pressure in the duct for the gases to flow along during a firing, said rise in pressure accumulates at the primary mechanism configured to actuate the discharging of fluid below a certain pressure threshold.

The primary mechanism includes a needle including a head that adjusts the flow rate of discharge of fluid by blocking/unblocking the neck of the discharge zone, and the rise in pressure in the duct causes the displacement of the needle when the rise in pressure is greater than the internal pressure of the tank, thus allowing for the discharging of the pressurized fluid contained in said tank.

In another embodiment, the system transmitting the order to discharge is based on the recoil of the breech in relation to the support or is based on the detecting of gas or combustion gas pressure of the weapon in order to transmit the discharge order to the primary system to discharge the fluid, said discharge order being transmitted by means of a mechanism chosen from an electrical, mechanical, electromechanical or hydraulic mechanism. For example the device uses the movement of the breech in relation to the frame to actuate the valve of the primary mechanism by means of an electromagnetic mechanism thus allowing for the discharging of fluid.

BRIEF DESCRIPTION OF THE FIGURES

The invention shall be better understood when reading the following description and examining the accompanying figures. The latter are presented only for the purposes of information and in no way limit the invention.

In the drawings, similar elements that provide the same functions, even with a different shape bear the same reference.

DETAILED DESCRIPTION OF THE EMBODIMENT

The present invention proposes a device for inhibition of the recoil of a weapon intended for being attached to the rear of a weapon. The device is very advantageous in that it can be adapted to its use with different types of weapons available in the market. According to a chosen weapon, said device is adapted to carry out a discharging of fluid generating a momentum that opposes the momentum generated by the projectile and the gases burned during a firing of said weapon.

Figure 1:
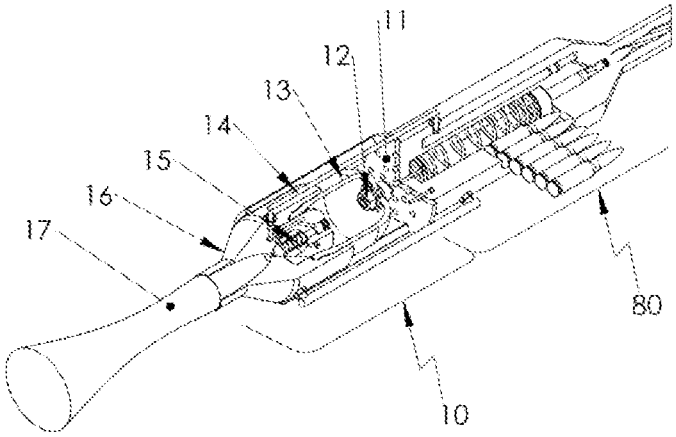
FIG. 1 shows the device (10) according to the invention mounted at the rear of a barrel (80) according to an embodiment. The partial cross-section of the isometric view makes it possible to understand the interactions, as well as the resulting stream of material.

More particularly, the present invention relates to a device (FIG. 1) for inhibition in the axis of the barrel of the recoil intended for being implemented with a firearm, said device carrying out a discharging of pressurized fluid in a direction opposite the axis of the barrel in order to absorb the recoil of the weapon.

Contrary to the weapons without recoil of the prior art, the device of the invention is particular in that it is a part independent from the weapon attached to the rear of the latter and includes specific and exclusive elements for the operation of said device.

The device (10) of the invention comprises:

a support (11) to be attached to the weapon;

an exclusive tank (13) of said device and including the fluid to be discharged;

a secondary mechanism (12) for sealing and filling the tank (13) by an external system (not shown) intended for supplying said tank and being independent from the firearm;

a system transmitting an order to discharge (14) fluid synchronized with the firing of the weapon;

a primary mechanism (15) for sealing and discharging fluid; and a part with a discharge zone (16) including a neck (16*b*) cooperating with said primary mechanism (15).

The detailed description hereinbelow relates to particular embodiments of the invention, but the latter is not limited to only these embodiments. In the same way, the numerical values are provided only by way of example and do not in any way limit the invention. The device shown in FIGS. 1-6 corresponds to an embodiment wherein the system transmitting the discharge order includes a duct including an incompressible fluid able to be connected with a duct for the gases to flow along of the weapon when the device is attached to said weapon. Said duct opens onto the primary mechanism for sealing and discharging the tank (13) and transmits the discharge order by means of a rise in pressure in said duct, such as details will be provided hereinafter. This embodiment is given by way of example and the device of the invention can use other mechanism for transmitting the discharge order to the primary mechanism (15) without leaving the scope of the invention.

Figure 2:
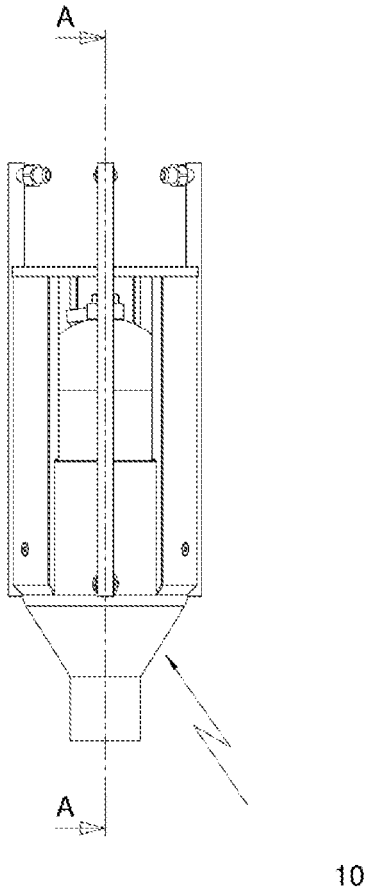
FIG. 2 shows the device according to the invention, according to an embodiment.
Figure 4:
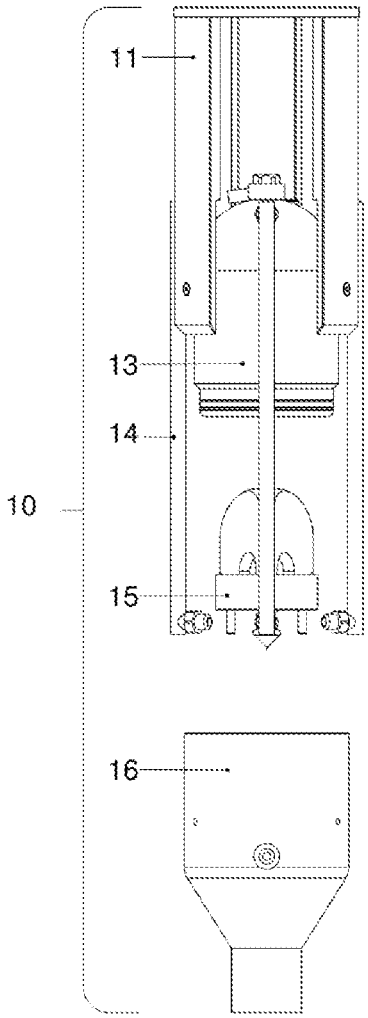
FIG. 4 shows an exploded view of FIG. 2 of the device according to the invention in an embodiment.

In reference to FIG. 2 and FIG. 4, the device (10) according to the invention comprises:

- a support to be attached to a weapon (11);
- a secondary mechanism (12) such as valve mechanism;
- a tank (13);
- a duct for the gases to flow along (14);
- a primary mechanism (15) such as a valve mechanism; and
- a part with a discharge zone (16).

Figure 3:
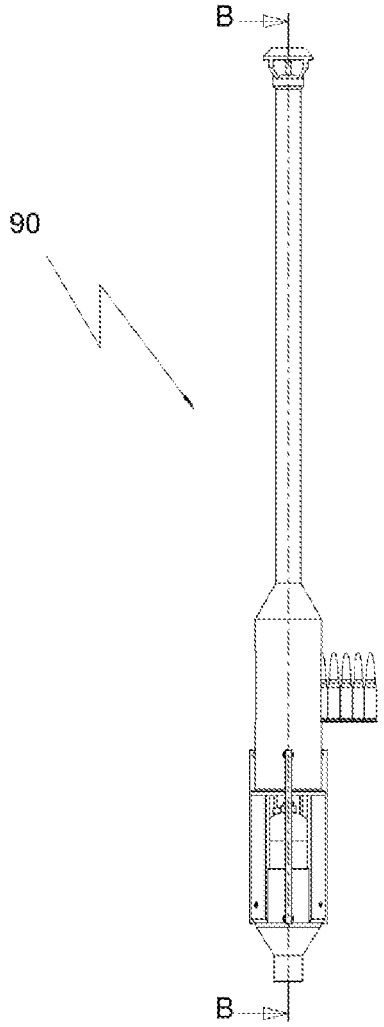
FIG. 3 shows the device (10) at the rear of a firearm (80) in an embodiment constituting the assembly (90).
Figure 5:
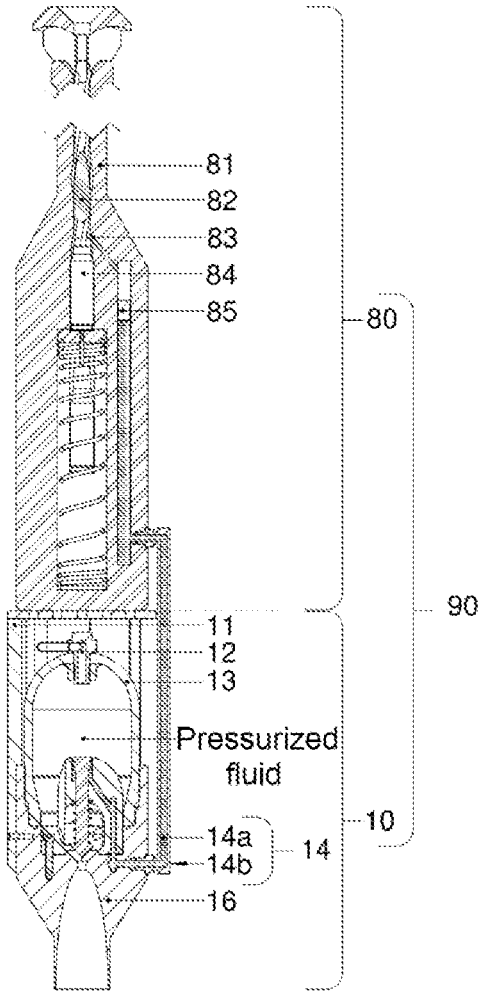
FIG. 5 shows as a cross-section FIG. 3 with the device at the rear of a firearm, as well as the interactions thereof in an embodiment.

In reference to FIG. 3 and FIG. 5, the assembly (90) is comprised of the device (10) according to the invention in an embodiment attached to the rear of any firearm (80). The latter (80) is not part of the device of the invention, but is necessary for the compression, mainly includes:

- an attaching frame (81) that transmits all the forces to the support (11);
- a projectile (82);
- a duct for the expanding combustion gases (83);
- a casing (84); and
- a piston (85) that transmits the combustion gas pressure to the duct for the gases to flow along (14) via a fluid (14*a*).

Figure 6:
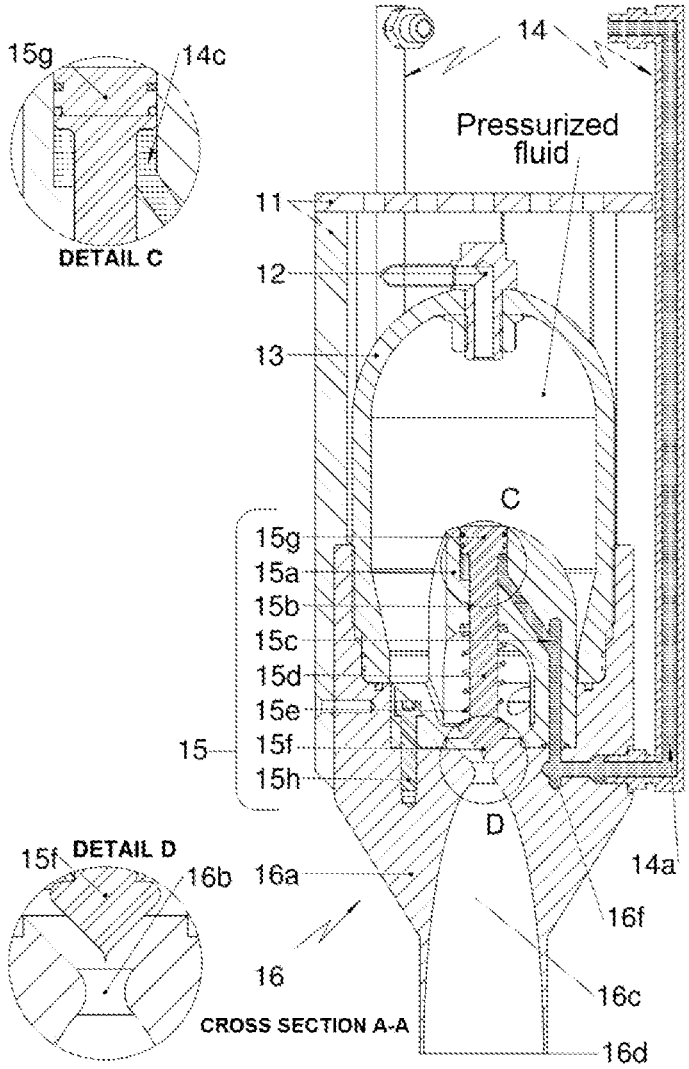
FIG. 6 is a detailed cross-section of FIG. 2 showing the device according to the invention in an embodiment.

In reference to FIG. 5 and FIG. 6, the duct for the gases to flow along (14) comprises:

- the fluid (14*a*) propagating the pressure wave coming from the piston (85) to the device (10);
- a duct (14*b*) containing the fluid (14*a*) connected at one end to the firearm (80) and at the other end to the device (10); and
- a filling zone (14*c*).

In reference to FIG. 6, the primary mechanism (15) for sealing and discharging comprises:

- a support (15*a*) attached to the part with the discharge zone (16) via attaching members (15*h*);
- a duct (15*c*) allowing for the passage of the fluid (14*a*);
- a needle (15*d*); and
- a return spring (15*e*).

In reference to detail C and detail D of FIG. 6, the needle (15*d*) mainly includes 2 specific zones located at its ends:

- a head of the needle (15*f*); and
- a rear of the needle (15*g*).

In reference to FIG. 6, the part with the discharge zone (16) mainly comprises:

- a machined support (16*a*) allowing for the assembly of the different elements of the device;
- the neck for the flow (16*b*);
- an expansion zone (16*c*);
- an outlet section (16*d*); and
- an internal duct (16*f*) that connects the ducts (14*b*) and (15*c*) together in order to allow for the passage of the fluid (14*a*).

The tank (13), contains a pressurized fluid which can be in this embodiment air. This tank is supplied by an external system via a secondary filling mechanism (12). The filling can be provided permanently or synchronized with the mechanism of the firearm.

In this embodiment, during the firing of the firearm (80), the chemical element in combustion contained in the casing (84) generates hot gases that push the projectile (82) forward. As soon as the projectile has passed the point of entry (83), the piston (85) is displaced by the pressure transmitting the pressure wave generated by the combustion gases to the duct for the gases to flow along (14). The fluid (14*a*) of this duct will, via the duct (16*f*) and (15*c*) accumulate in the space (14*c*), between the support (15*a*) and the tail of the needle (15*g*) (FIG. 7). This rise in pressure greater than the internal pressure of the tank will displace the needle (15*d*). The displacement of the latter will break the seal between the head of the needle (15*f*) and the rear of the neck (16*b*) (FIG. 8), which will release the pressurized fluid in the expansion zone (16*c*).

When the force exerted on the needle (15*d*) by the pressure internal to the tank and the return spring (15*e*) is greater than the pressure of the fluid (14*a*) of the flow of gases; the head of the needle (15*f*) will fold back on the neck (16*b*) and again provide a seal allowing the tank (13) to be filled. The device (10) is again ready for another firing cycle.

In this embodiment, the neck (16*b*) and the expansion zone (16*c*) take the shape of a de Laval nozzle. This neck (16*b*) imposes a sonic limit to the exiting fluid and consequently the mass flow rate of the device (10). The expansion zone (16*c*) of diverging shape allows for the expansion of this fluid via a decrease in pressure and an increase in speed. The diameter at the end of this zone (16*d*) is said to be "adapted" to make it possible to use as much as possible the energy contained in the pressurized fluid by providing an outlet pressure of the fluid equivalent to the pressure of the external environment.

At this moment, the momentum of the expelled air equalizes the momentum of the projectile and of the burned gases.

More particularly, the nozzle has a physical phenomenon specific to it where the speed of the fluid in its neck cannot have a speed greater than the speed of sound in the neck. The flow can be subsonic, sonic, but not supersonic.

However the divergent of the nozzle is generally supersonic.

The pressure and temperature of the tank define the density of the fluid in the neck.

Consequently, the section of the neck, the temperature and the pressure in the tank determine the mass flow rate obtained through the neck. The fluid in this neck is not fully expanded and will progressively become fully expanded in the divergent until the moment when its pressure is equal to the external pressure (adapted nozzle).

The pressure in the divergent of the nozzle decreases, but the volume increases and continues to accelerate in order to reach its outlet speed which is according solely to the final section of the divergent.

In order to obtain a certain momentum at the end of the nozzle it is sufficient to determine the corresponding speed, because the mass flow rate is constant all along the nozzle.

The physics of the solution proposed is illustrated in the following momentum equation wherein the influence of the device is represented by the additional term $P_{nozzle}$. If the current barrels/howitzers/ . . . are considered with their damping system, we have:

$$\vec{0} = \overrightarrow{P_{\text{carriage}}} + \overrightarrow{P_{\text{shell}}} + \overrightarrow{P_{\text{combustiongas}}}$$

and we wish to suppress the momentum on the carriage/frame.

However if $P_{carriage}=0$ in the equation, this means that $P_{shell}=0$, (i.e., the shell has no mass or speed)

$$-\overrightarrow{P_{\text{carriage}}} = \overrightarrow{P_{\text{shell}}} + \overrightarrow{P_{\text{combustiongas}}} \neq 0$$

The device according to the invention makes it possible to add an analytical terms so that $P_{carriage}=0$ $$\overrightarrow{P_{carriage}}=\overrightarrow{P_{shell}}+\overrightarrow{P_{combustiongas}}+\overrightarrow{P_{nozzle}}=0$$

$$-\overrightarrow{P_{shell}}=\overrightarrow{P_{shell}}+\overrightarrow{P_{combustiongas}}.$$

INDUSTRIAL APPLICATION

This device according to the invention is particularly intended for military applications where the forces and pulses generated during firings are limiting factors in the designs and uses whether there are current or future. Using the device makes it possible for example for free-standing artillery systems using vehicles with wheels to be able to fire in any direction without bearing against the ground.

The invention claimed is:

1. A device to inhibit a recoil in an axis of a barrel of a firearm, the device discharges a pressurized fluid in a direction opposite a firing of the barrel to absorb the recoil of the firearm, the device being attachable a rear of the firearm and comprises:

a support attachable to the firearm;

a tank to store the pressurized fluid to be discharged, the tank being exclusive to the device;

a secondary mechanism configured to seal and to fill the tank by an external system configured to supply the tank and the external system being independent from the firearm;

a system configured to transmit a discharge order to discharge the pressurized fluid synchronized with the firing of the firearm;

a primary mechanism configured to seal and to discharge the pressurized fluid;

a part with a discharge zone comprising a neck cooperating with the primary mechanism; and wherein the system transmitting the discharge order comprises:

a first duct comprising an incompressible fluid and the first duct connectable to a second duct to enable gases to flow along the firearm when the device is attached to the firearm, and the first duct opening onto the primary mechanism; and the discharge order being transmitted by the incompressible fluid transmitting an increase in a pressure of the gases during the firing of the firearm, the pressure accumulating at the primary mechanism to actuate the discharge of the pressurized fluid until the pressure is below a predetermined pressure threshold.

2. The device of claim 1, wherein the discharge zone further comprises an expansion zone and an outlet section having a shape of a de Laval nozzle.

3. The device of claim 1, wherein the discharge zone has a flow profile of converging then diverging shape; and wherein a length and a diameter of the end of a divergent are configured to equalize pressures between an expelled fluid and the external environment.

4. The device of claim 1, wherein the primary mechanism comprises a needle comprising a head adjusting a flow rate of the discharge of the pressurized fluid by blocking or unblocking the neck of the discharge zone.

5. The device of claim 1, wherein the primary mechanism is configured to discharge a quantity of the pressurized fluid generating a momentum at an outlet section of the discharge zone equal to a momentum generated by the firing of a projectile and a combustion gas of the firearm.

6. The device of claim 1, wherein the pressurized fluid is a pressurized gas, mixture of pressurized gases, air, $CO_2$, water or liquid.

7. The device of claim 5, wherein the discharge zone is sized to generate said momentum at the outlet section when the pressurized fluid passes through the outlet section.

8. The device of claim 1, wherein the primary mechanism comprises an electrical, mechanical, electromechanical or hydraulic mechanism to actuate and control the discharge of the pressurized fluid.

9. The device of claim 1, wherein the primary mechanism comprises a needle comprising a head adjusting a flow rate of the discharge of pressurized fluid by blocking or unblocking the neck of the discharge zone; and wherein the needle is displaced when the increase in the pressure is greater than an internal pressure of the tank to discharge the pressurized fluid from the tank.

10. The device of claim 1, wherein the tank is filled from the external system following each firing of the firearm or continuously to maintain at least one of a predefined level of the pressurized fluid in the tank and a predefined pressure of the pressurized fluid in the tank.

11. The device of claim 1, wherein each of the primary mechanism and the secondary mechanism comprises a valve.

* * * * *